US008020734B1

(12) United States Patent
Vandendries et al.

(10) Patent No.: US 8,020,734 B1
(45) Date of Patent: Sep. 20, 2011

(54) HAND WASHING TIMING SYSTEM

(76) Inventors: Robert H. Vandendries, Sioux Falls, SD (US); Roxanne L. Vandendries, Sioux Falls, SD (US)

( * ) Notice: Subject to any disclaimer, the term of this patent is extended or adjusted under 35 U.S.C. 154(b) by 656 days.

(21) Appl. No.: 12/053,255

(22) Filed: Mar. 21, 2008

(51) Int. Cl.
*B67D 5/08* (2006.01)

(52) U.S. Cl. ..... 222/639; 222/52; 222/181.3

(58) Field of Classification Search ..... 222/181.3, 222/639, 63, 52
See application file for complete search history.

(56) References Cited

U.S. PATENT DOCUMENTS

| | | | | |
|---|---|---|---|---|
| 4,606,085 | A | 8/1986 | Davies | |
| 5,165,577 | A * | 11/1992 | Ophardt | 222/181.2 |
| 5,771,925 | A | 6/1998 | Lewandowski | |
| 5,952,924 | A | 9/1999 | Evans et al. | |
| 6,065,639 | A | 5/2000 | Maddox et al. | |
| 6,082,586 | A * | 7/2000 | Banks | 222/95 |
| 6,206,238 | B1 * | 3/2001 | Ophardt | 222/1 |
| 6,278,372 | B1 | 8/2001 | Velasco, Jr. et al. | |
| 6,426,701 | B1 | 7/2002 | Levy et al. | |
| 6,729,502 | B2 * | 5/2004 | Lewis et al. | 222/181.3 |
| 7,028,861 | B2 * | 4/2006 | Sayers et al. | 222/1 |
| 7,451,894 | B2 * | 11/2008 | Ophardt | 222/52 |
| 7,527,178 | B2 * | 5/2009 | Lewis | 222/333 |
| 7,611,030 | B2 * | 11/2009 | Reynolds et al. | 222/1 |
| 7,621,426 | B2 * | 11/2009 | Reynolds et al. | 222/325 |
| 2002/0061500 | A1 | 5/2002 | Collopy | |
| 2006/0231568 | A1 * | 10/2006 | Lynn et al. | 222/52 |
| 2006/0240397 | A1 | 10/2006 | Lynn et al. | |
| 2006/0272361 | A1 | 12/2006 | Snodgrass | |
| 2006/0273915 | A1 * | 12/2006 | Snodgrass | 340/573.1 |
| 2008/0185398 | A1 * | 8/2008 | Yang et al. | 222/52 |

FOREIGN PATENT DOCUMENTS

| | | |
|---|---|---|
| WO | WO2007120770 | 10/2007 |

* cited by examiner

*Primary Examiner* — Kevin P Shaver
*Assistant Examiner* — Donnell Long

(57) ABSTRACT

A hand washing timing system includes a housing with a perimeter wall that has a dispensing aperture extending therethrough. A fluid dispensing assembly is mounted in the housing and dispenses fluid outwardly of the dispensing aperture when actuated. The fluid dispensing assembly includes an actuator. A light emitter is mounted on the housing and emits visible light outwardly away from the housing when turned on. A timing assembly is electrically coupled to the light emitter and turns on the light emitter for a specified amount of time when the timing assembly is actuated. The timing assembly is in communication with the fluid dispensing assembly and is actuated when the fluid dispensing assembly is actuated. A light diffuser is mounted on the housing and covers the light emitter to increase a viewing angle of light emitted by the light emitter to at least 120 degrees with respect to the light emitter.

16 Claims, 3 Drawing Sheets

HAND WASHING TIMING SYSTEM

BACKGROUND OF THE INVENTION

1. Field of the Invention

The present invention relates to hand washing devices and more particularly pertains to a new hand washing device for ensuring that a person washes their hands for a specified amount of time.

2. Description of the Prior Art

The use of hand washing devices is known in the prior art, as are those devices used to ensure that a person washes their hands for a specified amount of time. While these devices fulfill their respective, particular objectives and requirements, the need remains for a system that not only provides a signaling means to a person to wash their hands for a specified amount of time, but which also signals to others that the person is washing their hand for that specified amount of time. In particular, such a system will be useful for supervisors to be able to see that an employee is washing their hands for the proper duration. For caregivers, this will ensure that a patient is being taken care of by an employee with properly sanitized hands. In the food industry, this will allow not only supervisors, but also customers, to see that the food handler has sufficiently cleaned their hands before preparing food. For the above reasons, a system is needed that will allow the viewing of the signaling means from a sufficient distance and viewing angle to ensure that not only the person washing their hands, but also those persons a distance from the person, can see the signaling means.

SUMMARY OF THE INVENTION

The present invention meets the needs presented above by generally comprising a housing that includes a perimeter wall bounding an interior space of the housing. The perimeter wall has an outer surface and an inner surface and has a dispensing aperture extending therethrough. A fluid dispensing assembly is mounted in the housing and dispenses fluid outwardly of the dispensing aperture when actuated. The fluid dispensing assembly includes an actuator extending through the perimeter wall. A light emitter is mounted on the housing and emits visible light outwardly away from the housing when the light emitter is turned on. A timing assembly is electrically coupled to the light emitter and turns on the light emitter for a specified amount of time when the timing assembly is actuated. The timing assembly is in communication with the fluid dispensing assembly and is actuated when the fluid dispensing assembly is actuated. A light diffuser is mounted on the housing and covers the light emitter. The light diffuser diffuses light emitted by the light emitter to allow viewing of the light emitted by a distance of at least 15 feet and by a specified viewing angle. The specified viewing angle is at least 120 degrees outwardly from the light emitter.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

The objects of the invention, along with the various features of novelty which characterize the invention, are pointed out with particularity in the claims annexed to and forming a part of this disclosure.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
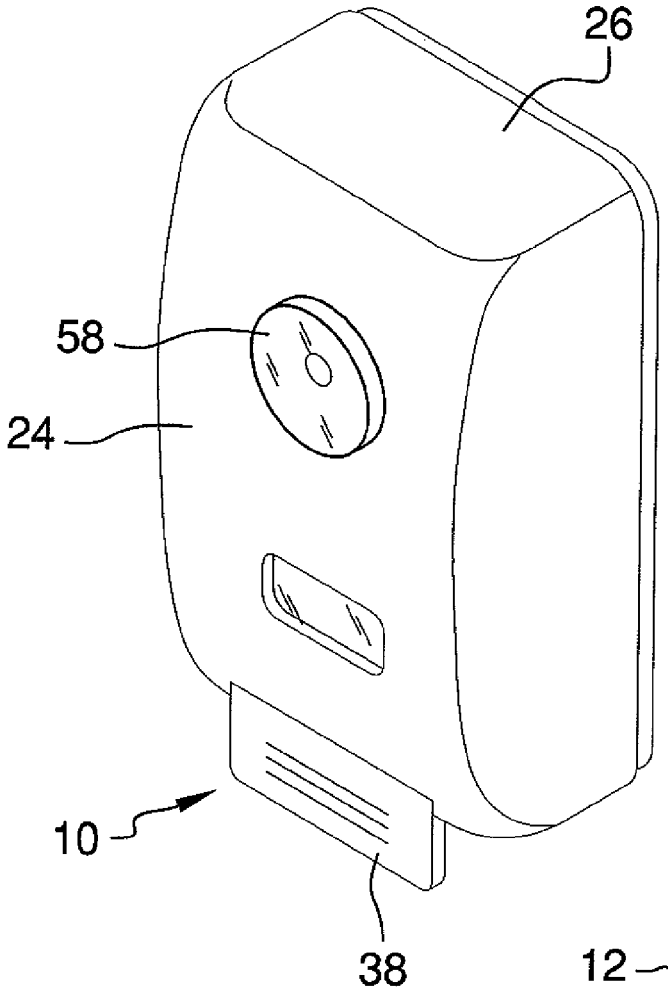
FIG. 1 is a front perspective view of a hand washing timing system according to the present invention.
Figure 2:
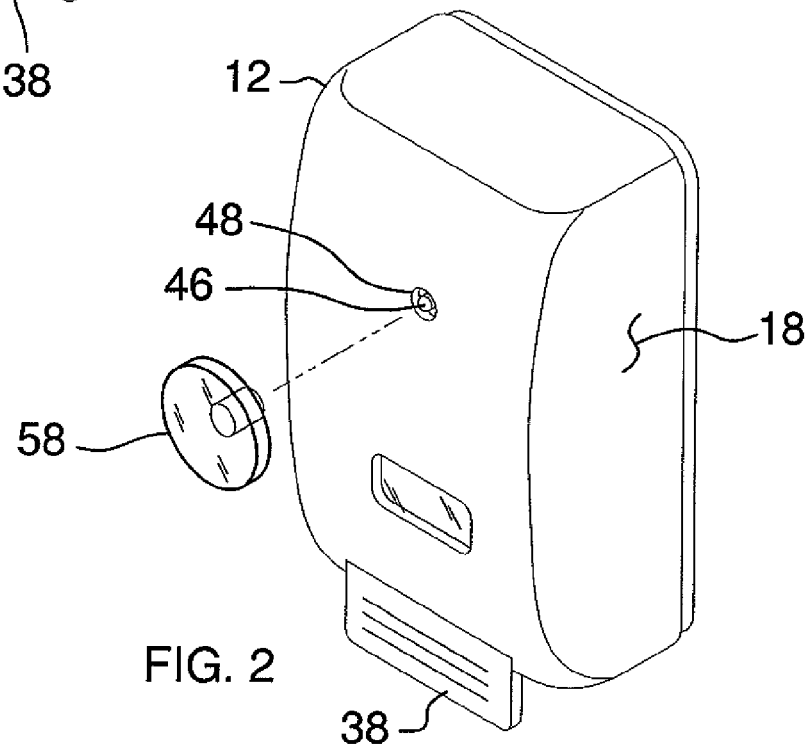
FIG. 2 is a front perspective expanded view of the present invention.
Figure 3:
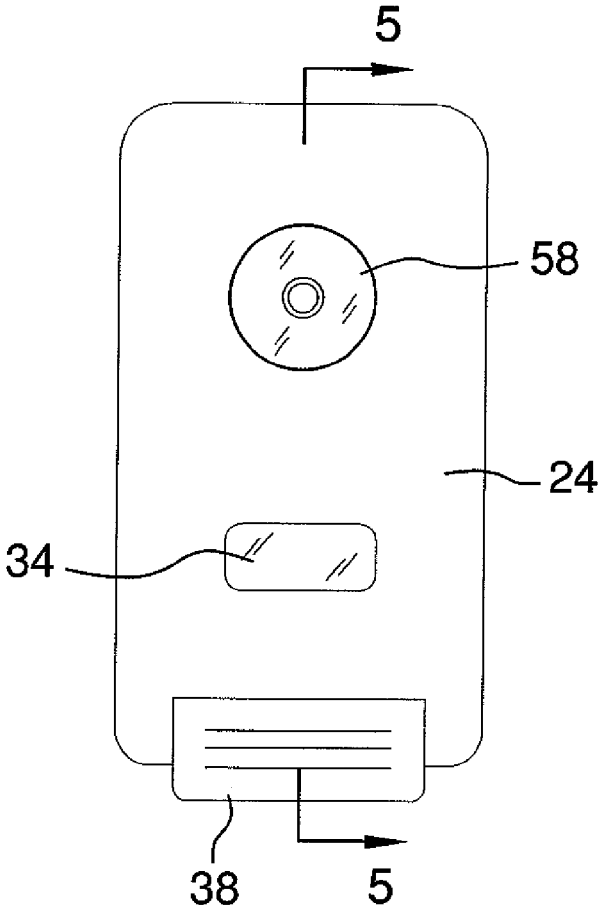
FIG. 3 is a front view of the present invention.
Figure 4:
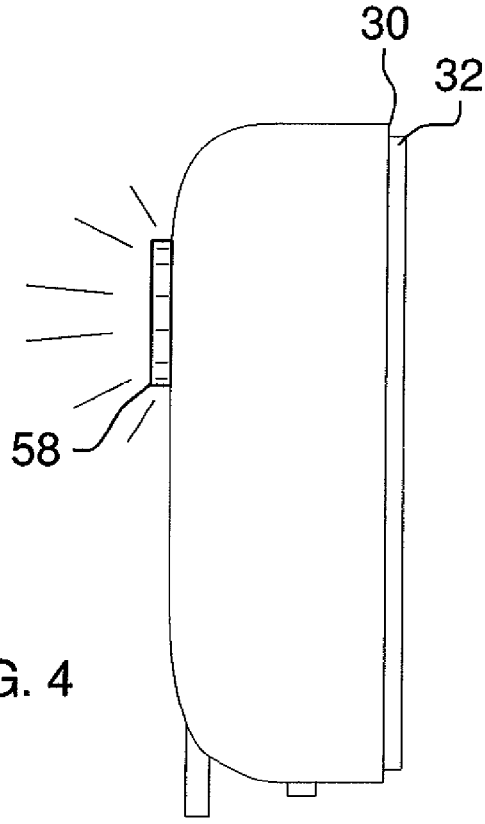
FIG. 4 is a side view of the present invention.

With reference now to the drawings, and in particular to FIGS. 1 through 7 thereof, a new hand washing device embodying the principles and concepts of the present invention and generally designated by the reference numeral 10 will be described.

As best illustrated in FIGS. 1 through 7, the hand washing timing system 10 generally comprises a housing 12 that includes a perimeter wall 14 bounding an interior space 16 of the housing 12. The perimeter wall 14 has an outer surface 18 and an inner surface 20. The perimeter wall 14 has a dispensing aperture 22 extending therethrough and the perimeter wall 14 includes a front wall 24, a top wall 26 and a bottom wall 28. The dispensing aperture 22 extends through the bottom wall 28. The housing 12 may include first 30 and second 32 portions hingedly coupled together to allow access into the interior space 16 of the housing 12. The perimeter wall 14 includes a viewing window 34 to view into the interior space 16.

A conventional fluid dispensing assembly 36 for dispensing liquid soap is mounted in the housing 12 and dispenses fluid outwardly of the dispensing aperture 22 when actuated. The fluid dispensing assembly 36 includes an actuator 38 extending through the perimeter wall 14. The actuator 38 is in mechanical communication with a pumping member 40 fluidly coupled to a container 42. The actuator 38 may be hingedly coupled to the inner surface 20 of the perimeter wall 14. The pumping member 40 releases a quantity of fluid, typically liquid soap, from the container 42 when the actuator 38 is actuated. The pump member 40 includes a dispensing nozzle 44 that extends outwardly of the housing 12 through the dispensing aperture 22.

A light emitter 46 is mounted on the housing 12 and emits visible light outwardly away from the housing 12 when the light emitter 46 is turned on. The light emitter 46 is mounted on the perimeter wall 14 and extends through a light aperture 48 in the perimeter wall 14. The light emitter 46 is positioned on the front wall 24 of the housing 12 and may comprise a light emitting diode, which may or may not be colored, such as red or blue, for example. Alternatively, the light emitter 46 may include a strobe light which repeated flashes when activated or may simply be programmed to flash intermittently.

Figure 5:
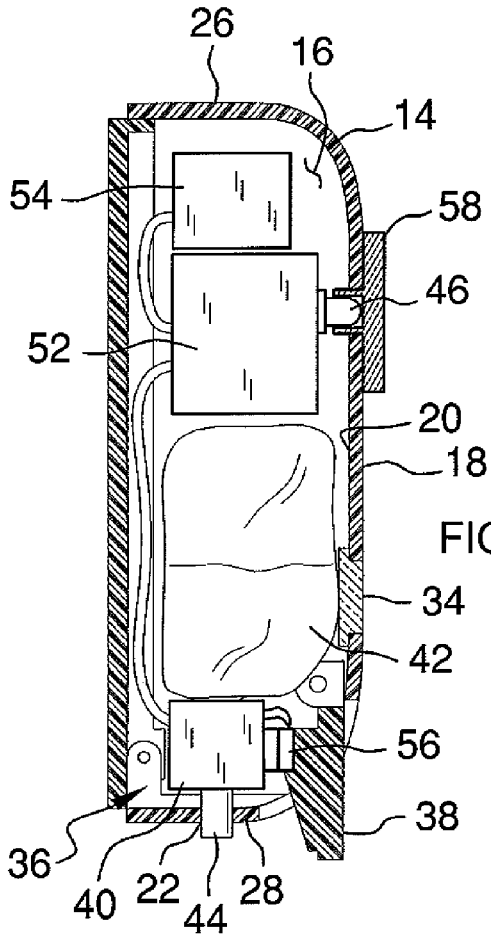
FIG. 5 is a cross-sectional view taken along line 5-5 of FIG. 3 of the present invention.
Figure 6:
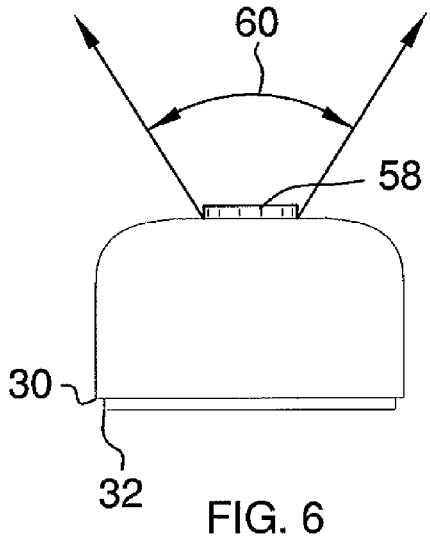
FIG. 6 is a top view of the present invention.
Figure 7:
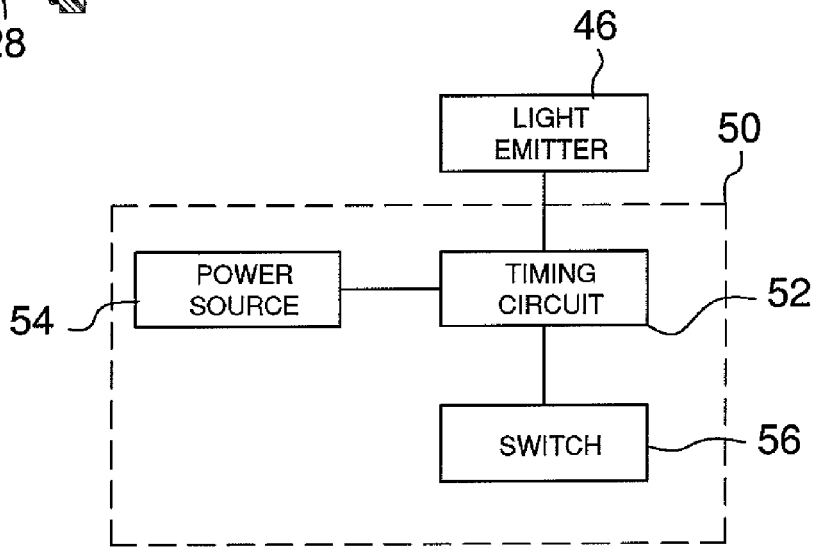
FIG. 7 is an electronic box diagram of the present invention.

A timing assembly 50 is electrically coupled to the light emitter 46. The timing assembly 50 turns on the light emitter 46 for a specified amount of time when the timing assembly 50 is actuated. The timing assembly 50 is in communication with the fluid dispensing assembly 36 and is actuated when the fluid dispensing assembly 36 is actuated. The specified amount of time is at least 10 seconds and less than 30 seconds, and may be at least 15 to 20 seconds. Alternatively, the time may be at least 2 minutes and up 10 minutes with a preferred time between 2 minutes and 6 minutes if the system 10 is being used by persons doing a surgical scrub. The timing assembly 50 is mounted in the housing 12 and includes a timing circuit 52 that is electrically coupled to the light emitter 46. The timing circuit 52 is configured to turn on the light emitter 46 for the specified amount of time when the timing circuit 52 is actuated and may comprise any well known type of electronic timing assembly or programmed processor. A power source 54 is electrically coupled to the timing circuit 52. The power source 54 may comprise a battery. A switch 56 is electrically coupled to the timing circuit 52 and is in mechanical communication with the fluid dispenser 36. The switch 56 is actuated by the fluid dispenser 36 when the fluid dispenser 36 is actuated. The switch 56 may be mounted on the pumping member 40, the actuator 38, as shown in FIG. 5, or on the perimeter wall 14 in such a position that it is abutted by and actuated by the actuator 38 when it is used.

A light diffuser 58 is mounted on the housing 12 and covers the light emitter 46. The light diffuser 58 diffuses light emitted by the light emitter 46 to allow viewing of the light emitted by a distance of at least 15 feet, and preferably by at least 25 feet, and by a specified viewing angle 60. If the viewing angle is clear to the light emitter 46, the light emitter 46 may be viewable up to at least 40 feet. The specified viewing angle is at least 120 degrees outwardly from the light emitter 46 and may be equal to at least 180 degrees. The light diffuser 58 extends outwardly away from the outer surface 18 of the perimeter wall 14. This ensures adequate viewing from a larger angle and will prevent the perimeter wall 14 from interfering with the viewing of the emitted light. If the diffuser is positioned on the top wall 26, the viewing angle will be 360 degrees laterally away from the housing 12. The diffuser 58 may be comprised of a plastic or glass material typically used for vehicle taillights or light reflectors and it may be colored, for example, such as red, blue, orange, yellow or green.

In use, the housing 12 is mounted to wall, adjacent to a sink, and the fluid dispensing assembly 36 is used in a conventional manner to dispense liquid soap. When the fluid dispensing assembly 36 is used, it will trigger the timing circuit 52 to turn on the light emitter 46 to signal to the person washing their hands to continue to wash their hands while the light emitter 46 is emitting light. The diffuser 58 ensures that other persons, such as supervisors, peers, patients or patrons, can see that the person is washing their hands for the specified amount of time. If the fluid dispensing assembly 36 is actuated again, the timing circuit 52 will start over and cause the light emitter 46 to emit light for the entire length of time after the dispensing assembly 36 was actuated again.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

We claim:

1. A hand washing timer and soap dispensing system, said system comprising:

a housing including a perimeter wall bounding an interior space of said housing, said perimeter wall having an outer surface and an inner surface, said perimeter wall having a dispensing aperture extending therethrough;

a fluid dispensing assembly being mounted in said housing and dispensing fluid outwardly of said dispensing aperture when actuated, said fluid dispensing assembly including an actuator extending through said perimeter wall;

a light emitter being mounted on said housing, said light emitter emitting visible light outwardly away from said housing when said light emitter is turned on;

a timing assembly being electrically coupled to said light emitter, said timing assembly turning on said light emitter for a specified amount of time when said timing assembly is actuated, said timing assembly being in communication with said fluid dispensing assembly and being actuated when said fluid dispensing assembly is actuated; and a light diffuser being mounted on said housing and covering said light emitter, said light diffuser diffusing light emitted by said light emitter to allow viewing of the light emitted by a distance of at least 15 feet and by a specified viewing angle, said specified viewing angle being at least 120 degrees outwardly from said light emitter.

2. The system according to claim 1, wherein said perimeter wall includes a front wall, a top wall and a bottom wall, said dispensing aperture extending through said bottom wall.

3. The system according to claim 2, wherein said actuator of said fluid dispensing assembly is in mechanical communication with a pumping member fluidly coupled to a container, said pumping member releasing a quantity of fluid from said container when said actuator is actuated, said pump member including a dispensing nozzle extending outwardly of said housing through said dispensing aperture.

4. The system according to claim 1, wherein said light emitter is mounted on said perimeter wall and extends through a light aperture in said perimeter wall.

5. The system according to claim 2, wherein said light emitter is mounted on said perimeter wall and extends through a light aperture in said perimeter wall.

6. The system according to claim 5, wherein said light emitter is positioned on said front wall of said housing.

7. The system according to claim 1, wherein said light emitter comprises a light emitting diode.

8. The system according to claim 1, wherein said specified amount of time being at least 10 seconds and less than 30 seconds.

9. The system according to claim 1, wherein said specified amount of time is at least 15 seconds.

10. The system according to claim 8, wherein said timing assembly includes:

a timing circuit being electrically coupled to said light emitter, said timing circuit being configured to turn on said light emitter for said specified amount of time when said timing circuit is actuated; and a power source being electrically coupled to said timing circuit;

a switch being electrically coupled to said timing circuit and being in mechanical communication with said fluid dispenser, said switch being actuated by said fluid dispenser when said fluid dispenser is actuated.

11. The system according to claim 1, wherein said light diffuser diffuses the light emitted by said light emitter to allow viewing of the light emitted by a distance of at least 25 feet, said specified viewing angle being at least 180 degrees outwardly from said light emitter.

12. The system according to claim 1, wherein said specified viewing angle is at least 180 degrees outwardly from said light emitter.

13. The system according to claim 12, wherein said light diffuser extends outwardly away from said outer surface of said perimeter wall.

14. The system according to claim 13, wherein said light emitter is positioned in a front wall of said perimeter wall.

15. The system according to claim 1, wherein said light diffuser extends outwardly away from said outer surface of said perimeter wall.

16. A hand washing timer and soap dispensing system, said system comprising:

a housing including a perimeter wall bounding an interior space of said housing, said perimeter wall having an outer surface and an inner surface, said perimeter wall having a dispensing aperture extending therethrough, said perimeter wall including a front wall, a top wall and a bottom wall, said dispensing aperture extending through said bottom wall;

a fluid dispensing assembly being mounted in said housing and dispensing fluid outwardly of said dispensing aperture when actuated, said fluid dispensing assembly including an actuator extending through said perimeter wall, said actuator being in mechanical communication with a pumping member fluidly coupled to a container, said pumping member releasing a quantity of fluid from said container when said actuator is actuated, said pump member including a dispensing nozzle extending outwardly of said housing through said dispensing aperture;

a light emitter being mounted on said housing, said light emitter emitting visible light outwardly away from said housing when said light emitter is turned on, said light emitter being mounted on said perimeter wall, said light emitter extending through a light aperture in said perimeter wall, said light emitter being positioned on said front wall of said housing, said light emitter comprising a light emitting diode;

a timing assembly being electrically coupled to said light emitter, said timing assembly turning on said light emitter for a specified amount of time when said timing assembly is actuated, said timing assembly being in communication with said fluid dispensing assembly and being actuated when said fluid dispensing assembly is actuated, said specified amount of time being at least 10 seconds and less than 30 seconds, said timing assembly being mounted in said housing, said timing assembly including;

a timing circuit being electrically coupled to said light emitter, said timing circuit being configured to turn on said light emitter for said specified amount of time when said timing circuit is actuated;

a power source being electrically coupled to said timing circuit;

a switch being electrically coupled to said timing circuit and being in mechanical communication with said fluid dispenser, said switch being actuated by said fluid dispenser when said fluid dispenser is actuated; and a light diffuser being mounted on said housing and covering said light emitter, said light diffuser diffusing light emitted by said light emitter to allow viewing of the light emitted by a distance of at least 15 feet and by a specified viewing angle, said specified viewing angle being at least 120 degrees outwardly from said light emitter, said light diffuser extending outwardly away from said outer surface of said perimeter wall.

* * * * *